United States Patent [19]

Amering et al.

[11] Patent Number: 4,912,009

[45] Date of Patent: Mar. 27, 1990

[54] TONER COMPOSITION AND METHOD OF MAKING

[75] Inventors: Allan R. Amering, Hilton; Dennis E. Smith, Rochester; John M. Spence, Pittsford, all of N.Y.

[73] Assignee: Eastman Kodak Company, Rochester, N.Y.

[21] Appl. No.: 292,470

[22] Filed: Dec. 30, 1988

[51] Int. Cl.[4] ..... G03G 9/08

[52] U.S. Cl. ..... 430/137; 430/110

[58] Field of Search ..... 430/110, 137

[56] References Cited

U.S. PATENT DOCUMENTS

| | | | |
|---|---|---|---|
| Re. 31,072 | 11/1982 | Jadwin et al. | 430/99 |
| 2,932,629 | 4/1960 | Wiley . | |
| 4,148,741 | 4/1979 | Bayley . | |
| 4,288,517 | 9/1981 | Arimatsu et al. | 430/110 |
| 4,299,903 | 11/1981 | Auclair et al. | 430/137 |
| 4,314,932 | 2/1982 | Wakimoto et al. . | |
| 4,816,366 | 3/1989 | Hyosu et al. | 430/137 |
| 4,833,060 | 5/1989 | Nair et al. | 430/110 X |
| 4,845,007 | 7/1989 | Hyosu et al. | 430/110 X |

FOREIGN PATENT DOCUMENTS

| | | | |
|---|---|---|---|
| 59-57252 | 4/1984 | Japan | 430/137 |
| 2070036 | 9/1981 | United Kingdom . | |

*Primary Examiner*—Paul R. Michl
*Assistant Examiner*—Jeffrey A. Lindeman
*Attorney, Agent, or Firm*—Bernard D. Wiese

[57] ABSTRACT

An electrophotographic dry toner having excellent properties with respect to charging, RH stability and fusing is made in a process in which the binder polymer is formed by suspension polymerizing a styrene-acrylic monomer mixture in the presence of a polyester-promoted colloidal silica suspending agent which is free of other hydrophilic polymers. The resulting polymer is melt blended with toner addenda such as a colorant and a charge control agent and the mixture is pulverized to form the toner composition.

19 Claims, 3 Drawing Sheets

TONER COMPOSITION AND METHOD OF MAKING

FIELD OF THE INVENTION

This invention relates to electrostatography and more particularly to an electrostatographic dry toner composition of excellent chargeability and environmental stability and to a method of making such a composition.

BACKGROUND

Electrostatography broadly includes the forming and developing of electrostatic image patterns either with or without light exposure through the use of an electrostatically charged toner composition. It includes electrophotography, as used, for example, in office copying machines, as well as processes such as dielectric recording which require no light exposure.

A principal type of electrostatically chargeable toner composition for such processes is a dry fusible powder composed mainly of a thermoplastic binder resin and a colorant such as carbon black or an organic pigment or dye. This kind of dry toner powder is normally used in a developer composition in admixture with carrier particles (usually larger in size than the toner particles). These triboelectrically charge the toner particles so that they can then be electrostatically attracted to oppositely charged areas of an electrostatic latent image to develope the image, the toner thereafer being transferred to and fixed by fusion or other means to an image receiving sheet, e.g., a sheet of paper.

One successful type of dry toner composition employs as the binder resin a fusible styrene-acrylic copolymer which, advantageously, can be lightly crosslinked, as disclosed in the patent to Jadwin et al, Re. 31,072 of Nov. 2, 1982.

In the past, styrene-acrylic toners have been made by synthesizing the binder polymer in an emulsion polymerization or suspension polymerization reaction. The polymer is then melt blended with carbon black or other colorant and with a charge control agent and possibly other addenda. The blend is solidified and mechanically pulverized to small particle size. Styrene-acrylic toners made in this way have had at least one drawback—the polymer often contains a high concentration of surfactant or other materials required in the polymerization. These are difficult to remove by any economically feasible means. As a consequence the toners tend to be environmentally unstable. That is to say, their chargeability or ability to maintain a high level of electrostatic charge varies with the environmental conditions of temperature and humidity. As a consequence, low relative humidity can cause an increase in image mottle and low solid area density in the copies. High relative humidity results in increased image density and background development. Daily and seasonal fluctuations in the environment can thus result in unstable performance of the copying apparatus.

Vinyl polymers have also been made by a suspension polymerization method of the kind described in the patent to Wiley, U.S. Pat. No. 2,932,629. The patent, which did not relate to toner manufacture, called the method "quiescent suspension polymerization." According to Wiley, polymer beads of small and uniform size were obtained in a suspension polymerization process by dispersing a liquid vinyl monomer in an aqueous medium that contains a colloidal suspending agent such as bentonite clay. The latter functioned to limit the coalescence of the polymerizable monomer droplets, the result being small, uniform polymer beads.

Later publications have reported using a similar technique for synthesizing toner beads, with the colorant and other addenda being included in the reaction mixture. U.K. Patent Application 2,070,036A published Sep. 3, 1981 describes making a styrene-acrylic toner by suspension polymerization of the monomers in the presence of colloidal silica. By obtaining toner beads directly from the synthesis, grinding of the polymer is unnecessary.

Although the direct suspension polymerization process for toner beads avoids the problem of surfactant contamination of the toner, a serious problem occurs. The suspending agent or dispersant, as it is also called, remains firmly bound to the surfaces of the polymer beads in a high concentration. Unless removed in some way, this suspending agent will harm the electrical properties of the beads. The toner will not be chargeable to a high stable voltage. A possible explanation is that the suspending agent, e.g., hydrophilic silica, transfers from the toner particles to the carrier particles, coating the surfaces of the latter and preventing triboelectric charging of the toner. The problem evidently has been recognized in recent patents, though described in somewhat different terms. See, for example, Hyosu, U.S. Pat. No. 4,601,968 and Wada et al, U.S. Pat. No. 4,507,378. Both comment on attempts to wash a dispersant from the toner but, as the Hyosu patent indicates, too much of the dispersant will remain on the toner surfaces.

A hydrophilic polymeric suspending agent, namely, poly(vinyl alcohol), has also been used b applicants in combination with a polyester-promoted silica suspending agent in the suspension polymerization of certain vinyl monomers to form polymers from which blended toner compositions are made. The resulting toners, however, are less than desired with respect to environmental stability and fusing properties.

In summary, the preparation of polymers by conventional emulsion and suspension polymerization followed by melt compounding with addenda and pulverizing the blend has produced toners which contain undesirable contaminants. They are, therefore, electrically unstable with changes in the environmental humidity. On the other hand, the preparation of toner beads by suspension polymerization of monomers in admixture with toner addenda, yields toner beads without requiring pulverization. The toner surface, however, is contaminated with the suspending agent which prevents negative charging of the toner and can be removed only at considerable costs. Furthermore, polymers made by suspension polymerization using a promoted silica suspending agent which also includes a hydrophilic polymer suspending agent form blended toners which do not have the desired environmental stability.

In accordance with the present invention, toner particles are prepared which have excellent chargeabilty and environmental stability and excellent fusing properties. This is done without the need for a costly washing procedure.

BRIEF SUMMARY OF THE INVENTION

The method of the invention comprises forming a suspension in an aqueous medium of droplets of a hydrophobic monomer composition comprising styrene and an alkyl acrylate or methacrylate, the styrene content being at least 60 weight percent, forming on the surfaces of the monomer droplets a complex of hydrophilic silica and a polyester of a lower alkylene dicarboxylic acid and an amino alkanol, the complex being less hydrophilic than the silica alone and sufficiently hydrophobic to be attracted to the monomer droplets, subjecting the suspension to polymerization conditions in admixture with a free radical initiator which is soluble in the monomer and insoluble in water, recovering the polymerization product comprising polymer beads having said complex on their surfaces, melt blending the polymer beads with toner addenda to obtain a homogeneous blend and cooling and pulverizing the melt-blended product to obtain toner particles having said addenda and said complex or its components distributed within each toner particle and having no more than a small concentration of the complex or is components on the particle surfaces.

The product of the invention is the resulting electrostatographic toner powder which comprises mechanically pulverized particles of a toner polymer. Dispersed within each particle are toner addenda and a complex of hydrophilic silica with said polyester. On the surfaces of the particles there is no more than a small concentration of the complex.

DETAILED DESCRIPTION

Figure 1:
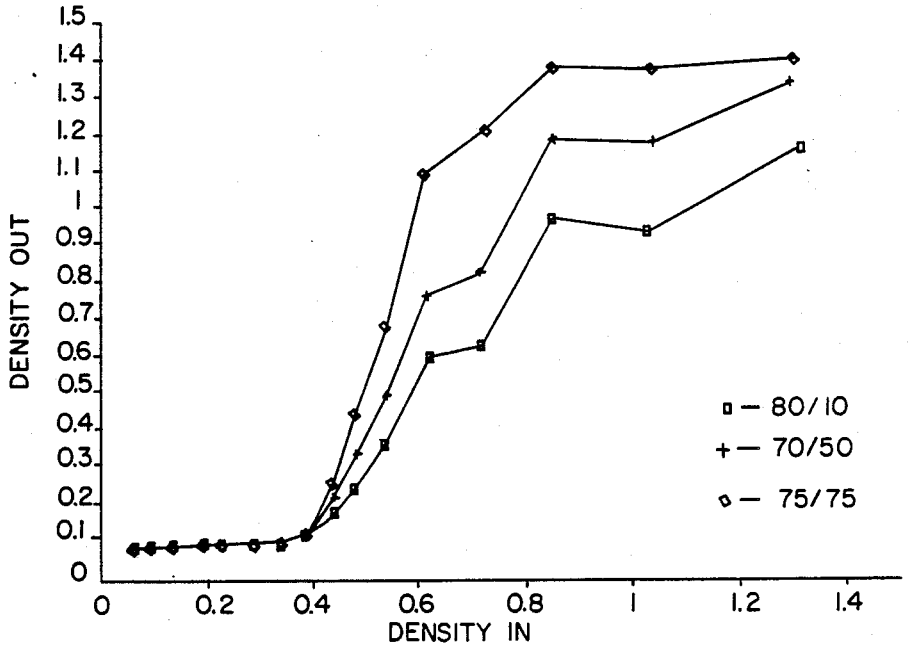
FIGS. 1–5 are plots of test data comparing toner compositions of the invention with other toners.

In the method of the invention the toner binder polymer is synthesized by suspension polymerization of the monomers. Water-insoluble monomers comprising styrene and an alkyl acrylate or methacrylate ester, are dispersed as small droplets in an aqueous medium. The droplets are stabilized by a water-dispersible but water-insoluble suspending agent.

The suspending agent used in the method of the invention is negatively-charged, solid colloidal silica. It is used with a water-soluble "promoter" that affects the hydrophobic-hydrophilic balance of the solid colloidal particles. More specifically, the promoter forms a complex with the suspending agent which is less hydrophilic than the colloidal particles of the suspending agent. The promoter has both hydrophilic and hydrophobic groups and reduces the hydrophilicity of the silica. The resulting complex is hydrophilic but less so than the silica. As stated in the patent to Wiley et al, U.S. Pat. No. 2,932,629, the promoter drives the particles of the solid colloid to the liquid-liquid interface of the oleophilic or hydrophobic monomer droplets and the aqueous medium.

The colloidal silica particles have dimensions from about 1 to 100 nanometers and preferably from about 5 to 70 nanometers. The size and concentration of these particles controls the size of the polymer particles.

Hydrophilic colloidal silica useful as the suspending agent is available commercially, for example, under the trade names and in the particle sizes as follows: LUDOX TM, 20 nm; LUDOX HS-40, 12 nm; LUDOX SM, 7 nm; and LUDOX AM, 12 nm; all supplied by E. I. du Pont de Nemours Company; and NALCOAG 1060, 60 nm supplied by Nalco Chemical Company.

The promoter used in the method of the invention is a condensation product of a lower alkylene dicarboxylic acid and an alkanol amine. The dicarboxylic acid can have an alkylene chain from about 2 to 6 carbon atoms in length. The preferred diacid of this class is adipic acid. The alkanol amine preferably is a lower alkanol amine, of which the alkanol groups contain from 1 to about 4 carbon atoms. Particularly useful alkanol amines are diethanolamine and methyl amino ethanol. With adipic acid these form the polyesters (by which term we also include polyesteramides), poly(diethanolamine adipate) and poly(methylamino ethanol adipate). These polyesters form a complex with hydrophilic colloidal silica, which is also hydrophilic but is less hydrophilic than the silica alone. As a consequence, the complex is compatible with the hydrophobic or oleophilic monomers dispersed in the aqueous reaction medium. The complex coats the monomer droplets and inhibits their coalescence.

Also desirable in the polymerization reaction mixture is a water-soluble substance to prevent the emulsion or solution polymerization of the monomers in the aqueous phase. A preferred example of such a water-soluble polymerization inhibitor is potassium dichromate. Others include sodium nitrite, copper salts, methylene blue or phenols.

An oil soluble, free radical initiator is required for the addition polymerization of the monomer or monomer mixture. By the term "oil soluble" is meant that the initiator is soluble in the water-insoluble monomer or monomer mixture. A range of known oil soluble, hydrophobic initiators for addition polymerization can be used. Examples include azo compounds such as 2,2'-azobis(2-methylbutyronitrile), 2,2'-azobis(isobutyronitrile). Commercial products of this type include VAZO 67, VAZO 64 and VAZO 52 initiators supplied by de Pont.

In one embodiment of the method of the invention, a mixture is formed of water, an inhibitor of solution polymerization (such as potassium dichromate), the promoter, i.e., the polyester of a lower alkylene dicarboxylic acid with an amino alkanol and the suspending agent, i.e., colloidal silica.

In a separate vessel the free radical initiator is dissolved in the liquid monomer or mixture of monomers. The monomer or monomer mixture is then added to the aqueous mixture in the reaction vessel with high shearing agitation to obtain a suspension of monomer droplets. The heavy shearing forces reduce the size of the monomer droplets and during this time an equilibrium is reached. The size of the droplets is stabilized or limited by the suspending agent complex which coats their surfaces.

The mixture is then heated and stirred in the reaction vessel to polymerize the monomer droplets. The resulting polymer beads are isolated by filtration and can, if desired, be slurried with water to remove water-soluble impurities and free suspending agent complex. No extensive washing or other purification is needed.

The polymer beads are next mixed with toner addenda. These normally include a colorant, such as carbon black and a charge control agent such as a quaternary ammonium salt. The mixture is then melt mixed or compounded on a hot roll mill or an extruder. The resulting homogeneous blend is solidified by cooling, crushed to a coarse particle size and then ground or pulverized to a fine powder by mechanical means such as a fluid energy mill. The average particle size of the powdered toner can be in the range from about 0.1 to 100 micrometers, a range from about 2 to 20 micrometers being preferred and a range of 5 to 10 micrometers being most preferred for current office copying machines.

The particles of the resulting finely ground toner powder comprise a binder polymer which has dispersed therein the toner addenda and the suspending agent, e.g., the complex of hydrophilic colloidal silica and the promoter. This toner has unexpected advantages. First it has good environmental stability or, as often called, RH stability. This means that the electrostatic charge which the toner is capable of developing triboelectrically by contact with carrier particles does not decrease substantially when the relative humidity (RH) of the environment increases and likewise does not increase substantially when RH decreases. The charge stays substantially constant.

A second advantage is that, without the need for extensive washing, the toner will triboelectrically charge to high voltages when contacted with appropriate carrier particles such as magnetic particles thinly coated with a fluorocarbon resin.

The reason for the improvement in RH chargeability is not clear. It is known, however, as previously mentioned, that a silica suspending agent on the surfaces of suspension polymerized beads will make it impossible to charge the toner to a sufficiently high voltage. While previous workers have tried to overcome the problem of poor chargeability by washing the polymer beads, applicants have found unexpectedly a better way. Applicants melt blend the polymer beads with toner addenda, so as to distribute the addenda and the suspending agent complex uniformly within the binder polymer matrix. The blended polymer is pulverized and the resulting polymer particles are homogeneous. The addenda and the complex are distributed uniformly within the toner particles. No more than a small concentration of the complex is on the particle surfaces and this small concentration does not undesirably reduce the triboelectric chargeability of the toner.

Although the marked reduction in the concentration of the complex on the particle surfaces is one possible explanation for the improved chargeability of Applicant's toner, there is also another possible explanation. There is some evidence that the suspending agent promoter acts as a solvent for the charge control agent which normally is included as a toner addendum. The theory then is that the charge control agent, because it is soluble in the promoter of the suspending agent complex, is more effectively utilized by the toner particles.

Still another advantage of the new toner composition is that it has excellent fusing characteristics, i.e., it has a relatively low onset of fusing temperature and, perhaps because of its cohesive strength, the toner is resistant to hot offset during fusing. In all of these advantageous properties the new toner composition is unexpectedly superior to toners made from styrene-acrylic polymers which contain higher alkyl acrylates, e.g., 2-ethylhexyl methacrylate when made by suspension polymerization with a hydrophilic polymer suspending agent such as poly(vinyl alcohol) and superior to toners containing emulsion polymerized polymers.

Although certain monomers are preferred, namely styrene and butyl acrylate, the method and toner compositions of the invention can utilize certain other related monomers which are capable of addition polymerization and which yield polymers useful as toner binders.

The largest component of the monomer composition is styrene or a styrene homolog such as methyl styrene. The styrene monomer is used in an amount of at least about 60 weight percent and preferably at least about 75 weight percent of the monomer composition. The composition also contains at least one alkyl acrylate or methacrylate. Preferably, this is a lower alkyl acrylate or methacrylate, i.e., in which the alkyl group contains from 1 to about 4 carbon atoms. Examples include esters of alphamethylene aliphatic monocarboxylic acids such as methyl acrylate, ethyl acrylate, n-butylacrylate, isobutyl acrylate, dodecyl acrylate, n-ocotyl acrylate, 2-chloroethyl acrylate, phenyl acrylate, methylalphachloroacrylate, methyl methacrylate, ethyl methacrylate, butyl methacrylate and the like.

Especially useful toner binders are fusible styrene polymers of from 75 to 95 percent by weight of styrene or styrene homologs and from 5 to 25 percent, by weight, of one or more lower alkyl acrylates or methacrylates. Fusible styrene-acrylic copolymers which are covalently lightly crosslinked with a divinyl compound such as divinylbenzene, as disclosed in the patent to Jadwin et al, U.S. Re 31,072, are especially useful.

Fusible toner particles prepared according to this invention can have fusing temperatures in the range from about 100° C. to 250° C. so they can readily be fused to paper receiving sheets. Preferred toners fuse in the range of from about 150° C. to 200° C. If the toner transfer is made to receiving sheets which can withstand higher temperatures, polymers of higher fusing temperatures can be used.

If a colorless image is desired, it is not necessary to add a colorant. However, more usually a colored image is desired and colorants selected from a wide variety of dyes nd pigments such as disclosed for example, in U.S. Reissue Patent No. 31,072 can be used. A particularly useful colorant for toners to be used in black-and-white elelctrophotography is carbon black. The amount of colorant in the toner can be from about 1 to about 30 percent, based on the weight of the toner, with from about 1 to 8 percent, by weight, of colorant being preferred.

Charge control agents useful in toner compositions of the invention are disclosed, for example, in U.S. Patent Nos. 3,893,935; 4,079,014; and 4,323,634. Charge control agents are employed in small quantities such as, from about 0.1 to about 3, weight percent, and preferably from about 0.2 to about 1.5 weight percent, based on the weight of the toner. Preferred charge control agents are quaternary ammonium salts which have long hydrocarbon groups. Examples include stearyl dimethyl benzyl ammonium chloride, lauramidopropyl trimethyl ammonium methylsulfate and p-nitrobenzyl dimethyloctadecyl ammonium chloride. These quaternary ammonium salts having long hydrocarbon chains are compatible or soluble with the silica-promoter complex which is present in the toner compositions of the invention.

Toners prepared in accordance with this invention are mixed with carrier particles to form developer compositions. The carrier particles can be selected from a variety of materials. Such materials include carrier core particles and core particles overcoated with a thin layer of film-forming resin.

The carrier core materials can comprise conductive, non-conductive, magnetic, or non-magnetic materials.

See, for example, U.S. Patents 3,850,663 and 3,970,571. Especially useful in magnetic brush development systems are iron particles such as porous iron particles having oxidized surfaces, steel particles, and other "hard" or "soft" ferromagnetic materials such as gamma ferric oxides or ferrites, such as ferrites of barium, strontium, lead, magnesium, or aluminium. See for example, U.S. Pat. Nos. 4,042,518; 4,478,925; and 4,546,060.

The carrier particles can be overcoated with a thin layer of a film-forming resin for the purpose of establishing the correct triboelectric relationship and charge level with the toner employed. Examples of suitable resins are described in U.S. Pat. Nos. 3,547,822; 3,632,512; 3,795,618; 3,898,170; 4,545,060; 4,478,925; 4,076,857; and 3,970,571. Especially useful as a thin coating for magnetic carrier particles is the "Kynar" vinylidene fluoride copolymer supplied by Pennwalt Corp.

A typical developer composition of the invention containing the above-described toner and a carrier vehicle comprises from about 1 to about 20 percent, by weight, of particulate toner particles and from about 80 to about 99 percent, by weight, carrier particles. Usually, the carrier particles are larger than the toner particles. Carrier particles can have a particle size on the order of from about 20 to about 1200 micrometers, usually about 30–300 micrometers being preferred.

The following examples further illustrate this invention.

EXAMPLE 1

SP Toner (a) Polymer Preparation

To prepare a toner binder polymer, 46.2 kg styrene, 13,8 kg butyl acrylate and 0.246 kg divinylbenzene (crosslinking agent) were mixed together and 1.7 kg of the free radical initiator, 2,2'-azobis(2-methylbutyronitrile) was dissolved in the mixture. To this was added 63.5 kg of demineralized water, 5.25 g of potassium dichromate, 0.335 kg poly(2-methylaminoethanol) adipate and 0.650 kg of colloidal silica, the latter being NALCOAG 1060 colloidal silica supplied by Nalco Chemical Company. The mixture was stirred rapidly to form a suspension and then the rate was reduced to gentle stirring. The suspension was heated to 77° C. for four hours followed by 90° C. for three hours. The product was cooled to 25° C., collected on a vacuum filter and dried for forty eight hours at 50° C.

(b) Toner Preparation

The poly(styrene-co-butylacrylate) binder polymer prepared as in (a) above was melt mixed on hot rolls to form a blended composition containing 92.5% by weight of the styrene/butylacrylate copolymer, 6% by weight of carbon black and 1.5% by weight of the charge control agent, stearyl dimethyl benzyl ammonium chloride, referred to as CA-A. After cooling, the blend was coarsely ground in a mechanical grinder and then pulverized in a fluid energy mill to a toner particle size of 10 to 12 μm volume average.

(c) Developer Preparation

A developer composition was prepared by blending together in a cone blender 12% by weight of the above-described toner composition and 88% by weight of carrier particles. These comprises a ferrite core coated with 1.25% by weight of a polymer coating containing 20% by weight of carbon black and 80% by weight of polyvinylidene fluoride copolymer ("Kynar" resin supplied by Pennwalt Corp.).

EXAMPLE 2

A toner composition and developer were prepared as in Example 1 except that the charge agent was lauramidopropyl trimethyl ammonium methylsulfate (CA-B) in the amount of 0.5% by weight.

EXAMPLE 3

A toner composition and developer were prepared as in Example 1 except that the charge agent was p-nitrobenzyl dimethyloctadecyl ammonium chloride (CA-C) in the amount of 0.5% by weight.

TESTING OF TONERS

Tests were carried out on Ektaprint® 250 electrophotographic copying machines of which the toner stations were modified for the use of small particle, magnetic developer compositions of the kind described in the patent to Miskinis et al, U.S. Patent 4,546,060. The tests were carried out over environmental extremes from 75° F. and 75% relative humidity (75/75) to 80° F. and 10% relative humidity (80/10). Each toner was equilibrated for 20 K copies of a standard test pattern. Then 15 K copies were imaged at the following environments: 80/10, 70/50, 75/75 and 70/50. Images were collected at each environment with a film voltage of −500 volts. Developer charge-to-mass, toner concentration, film voltages and f-stop values required for an aim contrast set up were recorded. Reflection density Din/Dout curves were analyzed along with the images to determine the sensitivity of toner composition to environmental conditions.

COMPARATIVE EXAMPLE

EP Toners

Toners like those of Examples 1 and 3 were prepared except that the toner binder polymer was synthesized by emulsion polymerization. The synthesis involved preparing a monomer mixture containing 75.7 weight percent styrene, 22.6 weight percent butylacrylate, 1.3 weight percent divinylbenzene and 0.2 weight percent n-dodecanediol. This was mixed in a continuous process with an aqueous solution of a water soluble initiator (ammonium persulfate) and a surfactant under reaction conditions including a temperature of 80° C. and a residence time of 80 hours. The latex was coagulated, filtered and dried. Powdered toner compositions and developers were prepared from the resulting polymer in the same manner as in Example 1, using the charge agents CA-A and CA-C, as in Examples 1 and 3, above. The developers were tested in the same manner as the toners of Examples 1, 2 and 3.

The table below shows the developer performance of the compositions of the examples under the different environmental conditions.

| Toner | | | Film Set-Up | Normalized |
|---|---|---|---|---|
| Example | Charge Agent | Environment °F./% RH | Voltage (neg. volts) | Charge-to-Mass Ratio (μC/g) |
| | | 80/10 | 510 | 31 |
| Compar- | CA-A | 70/50 | 470 | 21 |
| tive | | 75/75 | 380 | 21 |
| | | Range | 130 | 10 |
| | | 80/10 | 540 | 28 |
| Compar- | CA-C | 70/50 | 555 | 20 |

-continued

| Toner Example | Toner Charge Agent | Environment °F./% RH | Film Set-Up Voltage (neg. volts) | Normalized Charge-to-Mass Ratio (μC/g) |
|---|---|---|---|---|
| tive | | 75/75 | 400 | 14 |
| | | Range | 140 | 14 |
| | | 80/10 | 400 | 17 |
| 1 | CA-A | 70/50 | 440 | 21 |
| | | 75/75 | 430 | 19 |
| | | Range | 40 | 4 |
| | | 80/10 | 630 | 24 |
| 2 | CA-B | 70/50 | 670 | 22 |
| | | 75/75 | 680 | 26 |
| | | Range | 50 | 4 |
| | | 80/10 | 460 | 18 |
| 3 | CA-C | 70/50 | 490 | 18 |
| | | 75/75 | 490 | 18 |
| | | Range | 30 | 0 |

The data of the table show that the film set-up voltages required for the emulsion polymerized (EP) toners with either charge agent was significantly greater than those required for the suspension polymerized (SP) toners with either charge agent. From 90 to 110 volts more was required to set up the EP toners than the SP toners containing the Examples 1 and 3 charge agents. The normalized charge to mass value range was 10 and 14 for the EP toners but only 0 to 4 μC/g for the SP toners with the same charge agents. The SP toner of Example 2 performed similarly to the other SP toners of Examples 1 and 3.

Figure 2:
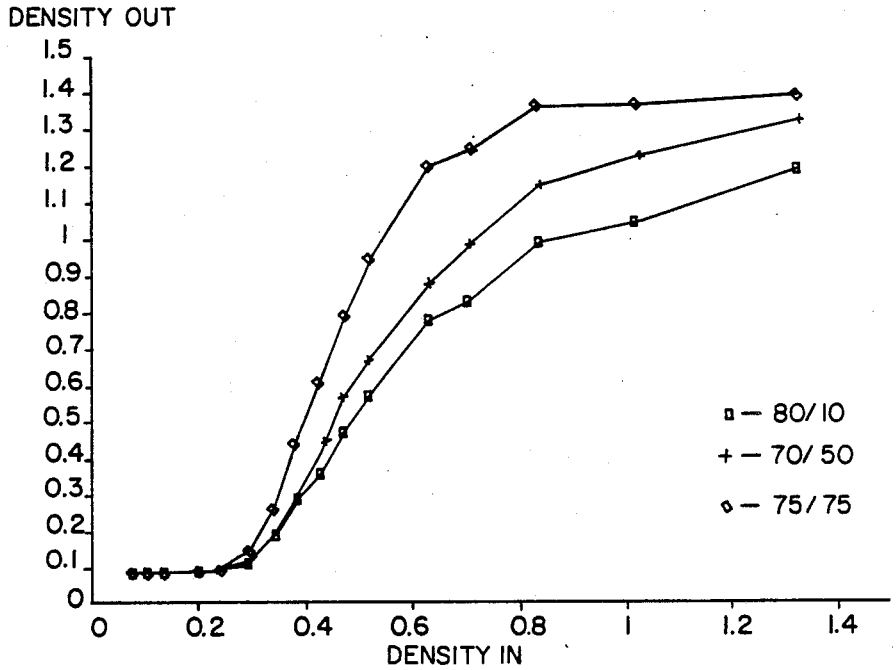
Figure 3:
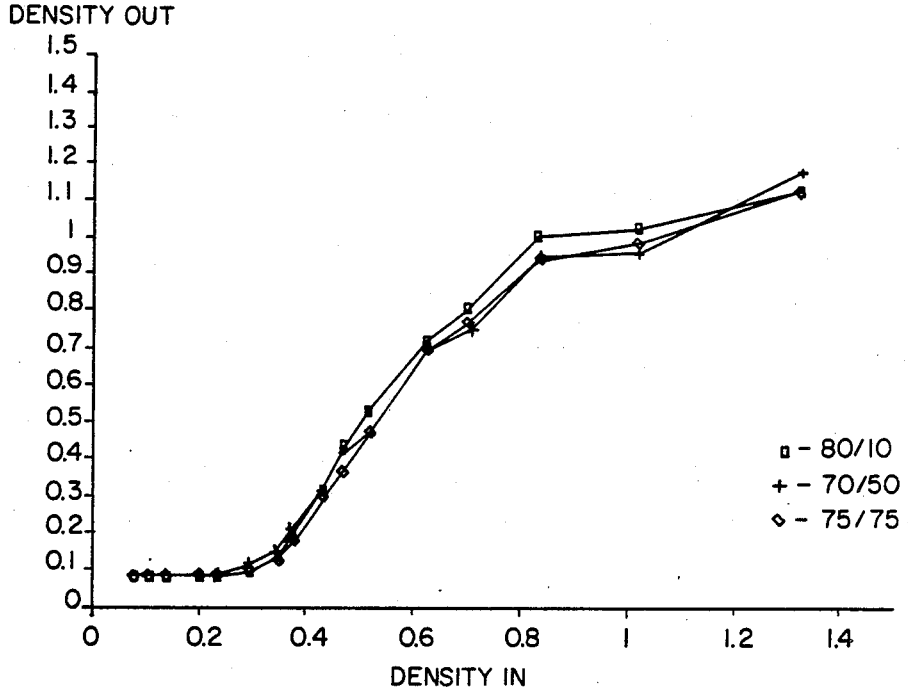
Figure 4:
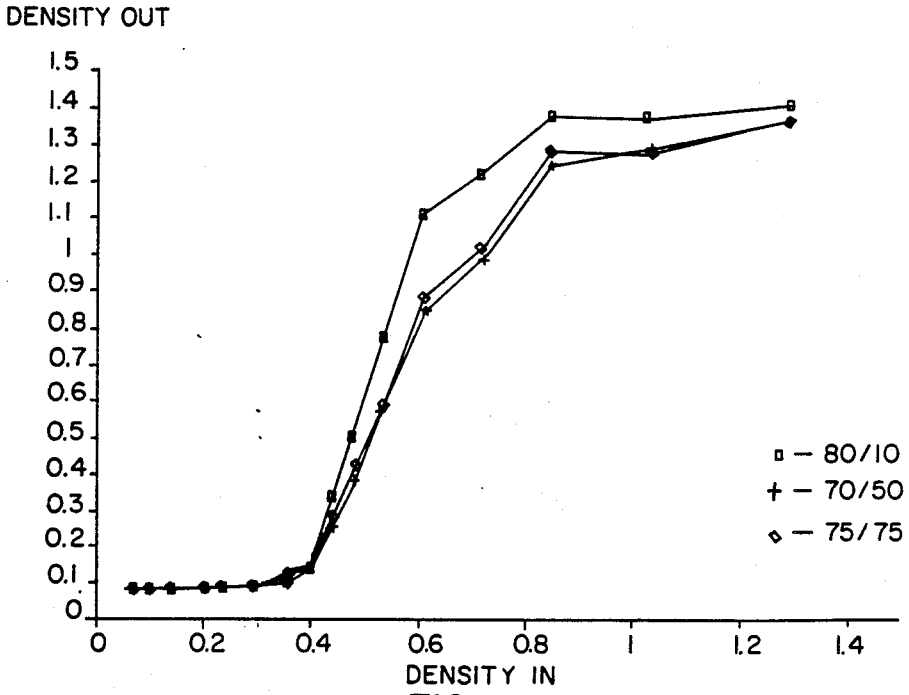
Figure 5:
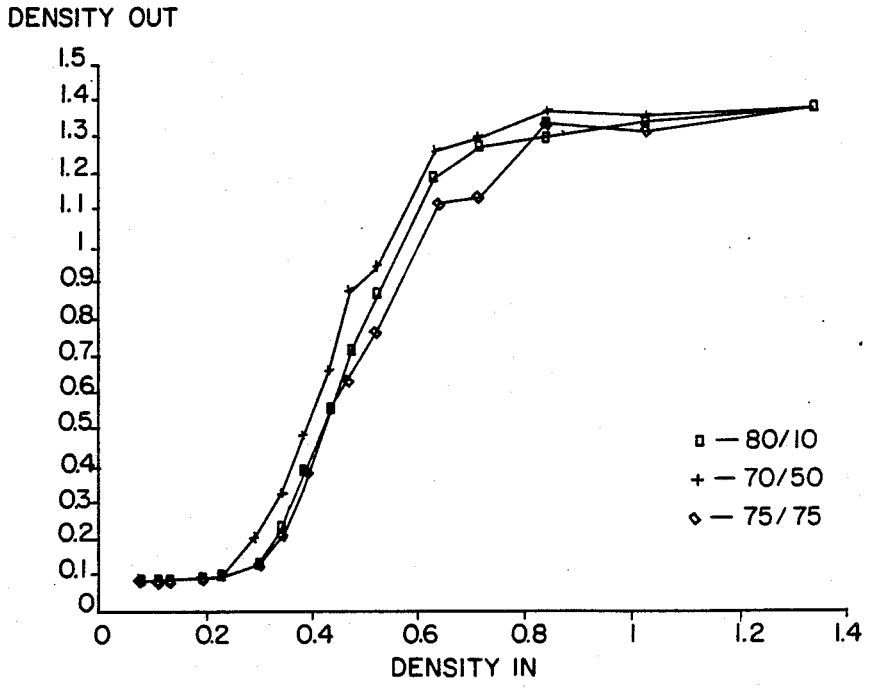

FIGS. 1–5 are plots of Din/Dout values for copies imaged under the same conditions with the five different toners. "Din" is the density of the test pattern and "Dout" is the density of the electrophotograhic copy. These curves reveal the contrast response to the environmental changes. The SP toners of Examples 1–3, as plotted in FIGS. 3–5, responded almost equally to environmental extremes as regards the ratio of Din/Dout. FIGS. 1–2, however, show that the EP toners of the Comparative example varied greatly in the Din/Dout ratio depending on the temperature/humidity conditions.

Although the fact that the suspending agent/promoter complex and other addenda are homogeneously dispersed within the toner polymer is an important advantage of the method of the invention, another advantage is that the mechanically pulverized toner particles are irregular in shape. As compared with bead polymer toners of regular spherical shape, the toner particles of the present invention have superior image transfer properties in the electrostatic transfer of a toner image from a photoconductor to paper or other receiving sheets.

The invention has been described in detail with particular reference to preferred embodiments thereof, but it will be understood that variations and modifications can be effected within the spirit and scope of the invention.

We claim:

1. A method of making a fusible styreneacrylic copolymer electrostatographic toner which comprises forming a suspension in an aqueous medium of droplets of a monomer composition comprising styrene and an alkyl acrylate or methacrylate, the styrene content of the monomer composition being at least 60 weight percent, forming on the surfaces of the monomer droplets a complex of hydrophilic silica with polyester of a lower alkylene dicarboxylic acid and an amino alkanol, the complex being less hydrophilic than the silica alone and sufficiently hydrophobic to be attracted to the monomer droplets, and said complex being substantially free of other hydrophilic polymers, subjecting the suspension to polymerization conditions in admixture with a free radical initiator which is soluble in the monomers and insoluble in water, recovering the polymerization product comprising polymer beads having said complex on their surfaces, melt blending the polymer beads with toner addenda, and cooling and pulverizing the melt blended product to obtain toner particles having said addenda and said complex or its components distributed within the toner particle and having no more than a small concentration of said complex or its components on the particle surfaces.

2. A method according to claim 1 wherein the complex consists essentially of silica and said polyester.

3. A method according to claim 2 wherein the alkyl acrylate or methacrylate is a lower alkyl acrylate or methacrylate.

4. A method according to claim 2 wherein the toner addenda include a charge control agent.

5. A method according to claim 4 wherein the charge control agent is soluble in said polyester.

6. A method according to claim 2 wherein the dicarboxylic acid is adipic acid and the amino alkanol is diethanolamine or methyl aminoethanol.

7. A method according to claim 6 wherein the charge control agent is stearyl dimethyl benzyl ammonium chloride, lauramidopropyl trimethyl ammonium methylsulfate or p-nitrobenzyl dimethyloctadecyl ammonium chloride.

8. A method according to claim 2 wherein the monomer composition comprises at least about 7 weight percent styrene and also includes a crosslinking agent.

9. An electrostatograhic toner powder comprising particles of a suspension polymerized copolymer of styrene and an alkyl acrylate or methacrylate, the styrene content being at least 60 weight percent, having dispersed therein toner addenda and a suspending agent complex or hydrophilic silica with a polyester of a lower alkylene dicarboxylic acid and an aminoalkanol, said complex being substantially free of hydrophilic polymeres.

10. A toner powder according to claim 9 wherein the complex consists essentially of silica and said polyester.

11. A toner powder according to claim 9 wherein the alkyl acrylate or methacrylate is a lower alkyl acrylate or methacrylate.

12. A toner powder according to claim 9 wherein the particles are irregular, pulverized particles.

13. A toner powder according to claim 9 wherein the concentration of the complex of hydrophilic silica on the surfaces of the toner particles is sufficiently low that the toner can triboelectrically charge to a high voltage when contacted with carrier particles coated with a fluorocarbon polymer.

14. A toner powder according to claim 9 wherein the toner addenda include a charge control agent.

15. A toner powder according to claim 14 wherein the charge control agent is soluble in said polyester.

16. A toner powder according to claim 14 wherein the charge control agent is stearyl dimethyl benzyl ammonium chloride, lauramidopropyl trimethyl ammonium methyl sulfate or p-nitrobenzyl dimethyloctadecyl ammonium chloride.

17. A toner powder according to claim 9 wherein said dicarboxylic acid is adipic acid and the amino alkanol is diethanolamine or methyl aminoethanol.

18. A toner powder according to claim 9 wherein the styrene content of the copolymer is at least 75 weight percent and the copolymer is crosslinked.

19. An electrostatographic developer comprising a mixture of (a) magnetic carrier particles coated with a fluorocarbon polymer and (b) a toner powder according to claim 9.

* * * * *